US005737678A

United States Patent [19]

Volkers et al.

[11] Patent Number: 5,737,678

[45] Date of Patent: Apr. 7, 1998

[54] LIQUID IMMERSION DEVELOPMENT MACHINE HAVING A MULTIPLE INTERMEDIATE MEMBERS IMAGE TRANSFER ASSEMBLY

[75] Inventors: Stewart W. Volkers, Ontario; Terry D. Seim, Webster, both of N.Y.

[73] Assignee: Xerox Corporation, Stamford, Conn.

[21] Appl. No.: 674,040

[22] Filed: Jul. 1, 1996

[51] Int. Cl.[6] ..... G03G 15/01

[52] U.S. Cl. ..... 399/302; 399/237; 399/308

[58] Field of Search ..... 399/237, 302, 399/307, 308, 297; 430/112, 116

[56] References Cited

U.S. PATENT DOCUMENTS

| | | | |
|---|---|---|---|
| 3,947,113 | 3/1976 | Buchan et al. | 399/308 |
| 4,453,820 | 6/1984 | Suzuki | 399/308 |
| 5,410,392 | 4/1995 | Landa | 399/308 |
| 5,434,657 | 7/1995 | Berkes et al. | 399/308 |
| 5,530,534 | 6/1996 | Dalal | 399/307 |
| 5,561,510 | 10/1996 | Kamp et al. | 399/308 |
| 5,570,173 | 10/1996 | Nye et al. | 399/237 |
| 5,585,905 | 12/1996 | Mammino et al. | 399/308 |
| 5,612,773 | 3/1997 | Berkes et al. | 399/307 |
| 5,627,632 | 5/1997 | Staudenmayer et al. | 399/297 X |

*Primary Examiner*—Sandra L. Brase
*Attorney, Agent, or Firm*—Tallam I. Nguti

[57] ABSTRACT

A liquid immersion development (LID) reproduction machine having an image forming surface that is protected against adverse heat effects. The LID reproduction machine includes an image transfer assembly, having multiple intermediate transfer members, suitable for transferring a toner developed image from the image forming surface onto a copy substrate without adverse heat effects on the image forming surface. The image transfer assembly includes a first intermediate transfer member that is mounted along the path of movement of the image forming surface and in contact with the image forming surface. The first intermediate transfer member as mounted forms a first unheated image transfer nip with the image forming surface for cold transferring the toner developed image from the image forming surface onto the first intermediate transfer member, thereby passively protecting the image forming surface from adverse heat effects such as adverse heat effects from contact with an otherwise heated intermediate transfer member. The image transfer assembly also includes a second intermediate transfer member that is mounted spaced from the image forming surface for receiving and transferring the toner developed image from the first intermediate transfer member to a copy substrate. The second intermediate transfer member as mounted forms a second unheated image transfer nip with the first intermediate transfer member, and a heated or transfixing image transfer nip with a back up roll at a point away from the first intermediate transfer member for transferring the toner developed image onto the copysubstrate.

6 Claims, 2 Drawing Sheets

LIQUID IMMERSION DEVELOPMENT MACHINE HAVING A MULTIPLE INTERMEDIATE MEMBERS IMAGE TRANSFER ASSEMBLY

BACKGROUND OF THE INVENTION

This invention relates to liquid immersion development (LID) reproduction machines, and more particularly to such a machine having an image transfer assembly including a plurality of intermediate transfer members for heat-protecting the image bearing member or photoreceptor.

Liquid electrophotographic reproduction machines are well known, and generally each includes an image bearing member or photoreceptor having an image bearing surface on which latent images are formed and developed as single color or multiple color toner images for eventual transfer to a receiver substrate or copy sheet. Each such reproduction machine thus includes a development system or systems that each utilize a liquid developer material typically having about 2 percent by weight of fine solid particulate toner material of a particular color, dispersed in a hydrocarbon liquid carrier.

In the electrophotographic process of such a machine, latent images formed on the image bearing surface of the image bearing member or photoreceptor are developed with the liquid developer material or materials containing the toner particles. The developed images on the photoreceptor typically each contain about 12 percent by weight of the toner particles in hydrocarbon liquid carrier. The developed image or images on the image bearing member conventionally are electrostatically transferred first from the image bearing surface to an intermediate transfer member, and then hot or heat transferred from the intermediate transfer member at a heated transfer or transfix nip to an image receiver substrate or copy sheet.

Typically, hot or heat transfer to the copy sheet requires that the intermediate transfer member be heated to about 100° C. for effective transfixing. The intermediate transfer member however, must then be cooled after such hot or heated transfer, back down to a temperature below 50° C. so that it will not, upon recontacting the image bearing surface, adversely affect the characteristics of the surface. To maintain such characteristics, it is generally accepted that the image bearing member preferably should be maintained at a temperature as low as 40° C. This requirement of heating and cooling the single intermediate transfer member is a problem, or at least a disadvantage, of conventional LID machines. This is because when the intermediate transfer member must be actively heated for transfixing, as well as, actively cooled within a short interval, that ordinarily necessitates a regenerative heat recovery system with cooling pads, heating pads, and heat pumps, thus increasing the cost, size, and complexity of a conventional LID image transfer assembly.

There is therefore a need for a LID reproduction machine that includes an image transfer assembly that overcomes the image transfer problems or disadvantages of conventional LID reproduction machines.

SUMMARY THE INVENTION

In accordance with the present invention, there is provided a liquid immersion development (LID) reproduction machine having an image forming surface that is protected against adverse heat effects. The LID reproduction machine includes a movable image forming member having a path of movement and an image forming surface; process stations mounted along the path of movement for forming a latent image onto the image forming surface; a development unit mounted along the path of movement and containing liquid developer consisting of liquid carrier and charged toner particles dispersed therein for developing the latent image thus forming a toner developed image; and an image transfer assembly, having multiple intermediate transfer members, suitable for transferring the toner developed image from the image forming surface onto a copy substrate without adverse heat effects on the image forming surface. The image transfer assembly includes a first intermediate transfer member that is mounted along the path of movement of the image forming surface and in contact with the image forming surface. The first intermediate transfer member as mounted forms a first unheated image transfer nip with the image forming surface for cold transferring the toner developed image from the image forming surface onto the first intermediate transfer member, thereby passively protecting the image forming surface from adverse heat effects such as adverse heat effects from direct contact with an otherwise heated intermediate transfer member. The image transfer assembly also includes a second intermediate transfer member that is mounted spaced from the image forming surface for receiving and transferring the toner developed image from the first intermediate transfer member to a copy substrate. The second intermediate transfer member as mounted forms a second unheated image transfer nip with the first intermediate transfer member, and a heated or transfixing image transfer nip with a back up roll, at a point away from the first intermediate transfer member, for transferring the toner developed image onto the copy substrate.

BRIEF DESCRIPTION OF THE DRAWINGS

Other aspects of the present invention will become apparent as the following description proceeds and upon reference to the drawings, in which.

DETAILED DESCRIPTION OF THE INVENTION

Figure 1:
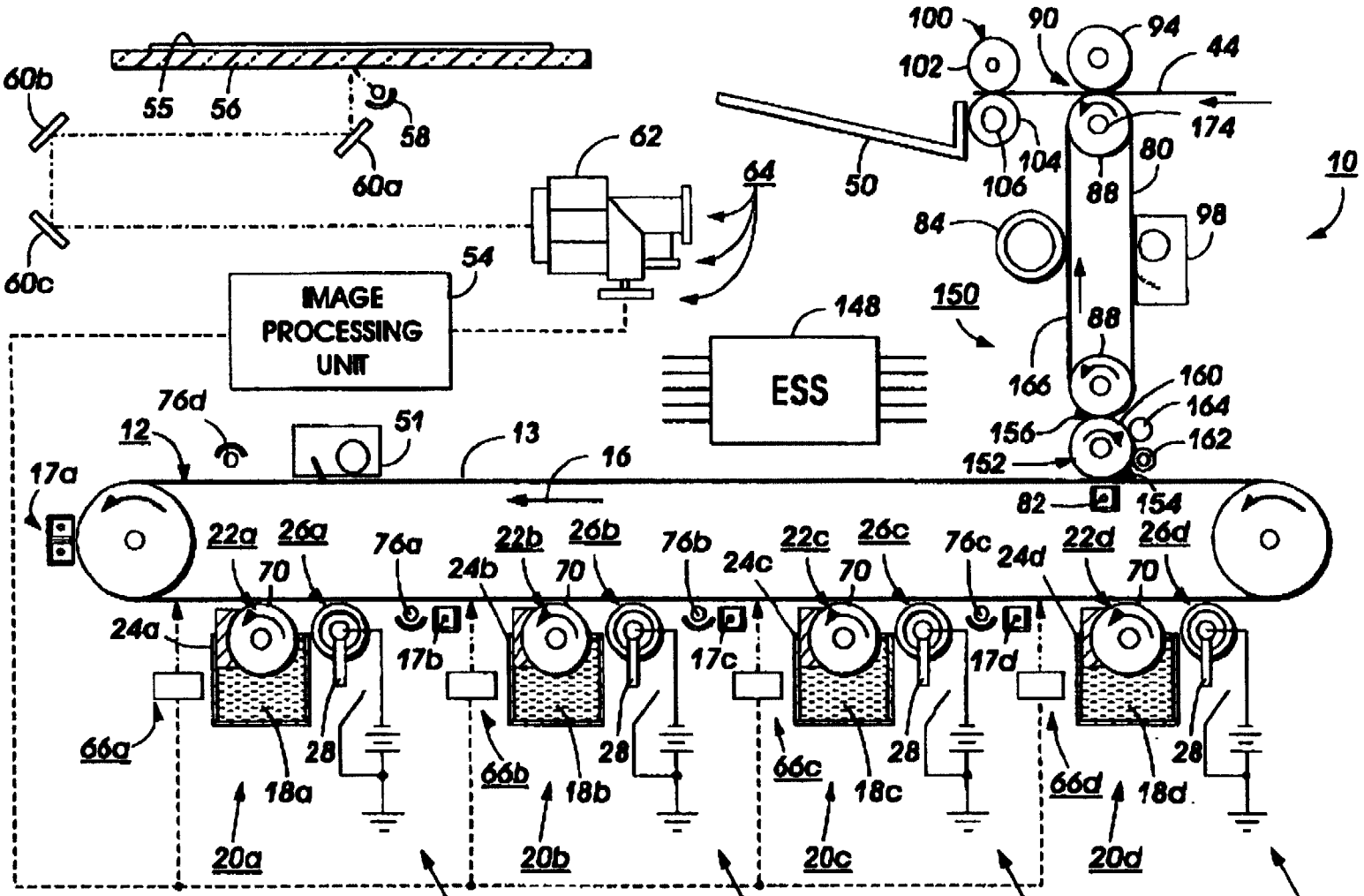
FIG. 1 is a vertical schematic of an exemplary color electrophotographic liquid immersion development (LID) reproduction machine incorporating an image transfer assembly in accordance with the present invention, in a first arrangement in which the second intermediate member has a first type of surface coating.

For a general understanding of the features of the present invention, reference numerals have been used throughout to designate identical elements. It will become evident from the following discussion that the present invention is equally well suited for use in a wide variety of reproduction machines and is not necessarily limited in its application to the particular embodiment depicted herein.

Inasmuch as the art of electrophotographic reproduction is well known, the various processing stations employed in the FIGS. 1 and 2 of the reproduction machine will be shown hereinafter only schematically, and their operation described only briefly.

Referring now to FIG. 1, there is shown a color electrophotographic reproduction machine 10 incorporating post-transfix fusing apparatus of the present invention. Although a multiple color LID machine is illustrated, it is understood a single color LID machine is equally suitable. The color copy process of the machine 10 can begin by either inputting a computer generated color image into an image processing unit 54 or by way of example, placing a color document 55 to be copied on the surface of a transparent platen 56. A scanning assembly consisting of a halogen or tungsten lamp 58 which is used as a light source, and the light from it is exposed onto the color document 55. The light reflected from the color document 55 is reflected, for example, by a 1st, 2nd, and 3rd mirrors 60*a*, 60*b* and 60*c*, respectively through a set of lenses (not shown) and through a dichroic prism 62 to three charged-coupled devices (CCDs) 64 where the information is read. The reflected light is separated into the three primary colors by the dichroic prism 62 and the CCDs 64. Each CCD 64 outputs an analog voltage which is proportional to the intensity of the incident light. The analog signal from each CCD 64 is converted into an 8-bit digital signal for each pixel (picture element) by an analog/digital converter (not shown). Each digital signal enters an image processing unit 54. The digital signals which represent the blue, green, and red density signals are converted in the image processing unit 54 into four bitmaps: yellow (Y), cyan (C), magenta (M), and black (Bk). The bitmap represents the value of exposure for each pixel, the color components as well as the color separation. Image processing unit 54 may contain a shading correction unit, an undercolor removal unit (UCR), a masking unit, a dithering unit, a gray level processing unit, and other imaging processing sub-systems known in the art. The image processing unit 54 can store bitmap information for subsequent images or can operate in a real time mode.

The machine 10 includes a photoconductive imaging member or photoconductive belt 12 which is typically multilayered and has a substrate, a conductive layer, an optional adhesive layer, an optional hole blocking layer, a charge generating layer, a charge transport layer, a photoconductive or image forming surface 13, and, in some embodiments, an anti-curl backing layer. As shown, belt 12 is movable in the direction of arrow 16. The moving belt 12 is first charged by a charging unit 17*a*. A raster output scanner (ROS) device 66*a*, controlled by image processing unit 54, then writes a first complementary color image bitmap information by selectively erasing charges on the charged belt 12. The ROS 66*a* writes the image information pixel by pixel in a line screen registration mode. It should be noted that either discharged area development (DAD) can be employed in which discharged portions are developed or charged area development (CAD) can be employed in which the charged portions are developed with toner.

After the electrostatic latent image has been recorded thus, belt 12 advances the electrostatic latent image to development station 20*a*. At development station 20*a*, a development roller 70, rotating in the direction as shown, advances a liquid developer material 18*a*, preferably black toner developer material, from the chamber of a development housing to a development zone or nip 22*a*. An electrode 24*a* positioned before the entrance to development zone or nip 22*a* is electrically biased to generate an AC field just prior to the entrance to development zone or nip 22*a* so as to disperse the toner particles substantially uniformly throughout the liquid carrier. The toner particles, disseminated through the liquid carrier, pass by electrophoresis to the electrostatic latent image. As is well known, the charge of the toner particles is opposite in polarity to the charge on the photoconductive or image forming surface 13.

After the first liquid color separation image is developed, for example, with black liquid toner, it is conditioned by a conditioning porous roller 26*a*, 26*b*, 26*c*, 26*d* having perforations through the roller skin covering. Roller 26*a* contacts the developed image on belt 12 and conditions the image by compacting the toner particles of the image and reducing the fluid content thereof (thus increasing the percent solids) while inhibiting the departure of toner particles from the image. Preferably, the percent solids in the developed image is increased to more than 20 percent by weight. Porous roller 26*a*, 26*b*, 26*c*, 26*d* operates in conjunction with a vacuum 28 which removes liquid from the roller. A pressure roller (not shown), mounted in pressure contact against the blotter roller 26*a*, may be used in conjunction with or in the place of the vacuum device 28, to squeeze the absorbed liquid carrier from the blotter roller for deposit into a receptacle.

In operation, roller 26*a*, 26*b*, 26*c*, 26*d* rotates in direction as shown to impose against the "wet" image on belt 12. The porous body of roller 26*a*, 26*b*, 26*c*, 26*d* absorbs excess liquid from the surface of the image through the skin covering pores and perforations. Vacuum device 28 located on one end of a central cavity of the roller 26*a*, 26*b*, 26*c*, 26*d*, draws liquid that has permeated into the roller, out through the cavity. Vacuum device 28 deposits the liquid in a receptacle or some other location for either disposal or recirculation as liquid carrier. Porous roller 26*a*, 26*b*, 26*c*, 26*d* then, continues to rotate in the direction as shown to provide a continuous absorption of liquid from the image on belt 12. The image on belt 12 advances to lamp 76*a* where any residual charge left on the photoconductive surface 13 of belt 12 is erased by flooding the photoconductive surface with light from lamp 76*a*.

As shown, according to the REaD process of the machine 10, the developed latent image on belt 12 is subsequently recharged with charging unit 17*b*, and is next re-exposed by ROS 66*b*. ROS 66*b* superimposing a second color image bitmap information over the previous developed latent image. Preferably, for each subsequent exposure an adaptive exposure processor is employed that modulates the exposure level of the raster output scanner (ROS) for a given pixel as a function of toner previously developed at the pixel site, thereby allowing toner layers to be made independent of each other. Also, during subsequent exposure, the image is re-exposed in a line screen registration oriented along the process or slow scan direction. This orientation reduces motion quality errors and allows the utilization of near perfect transverse registration. At development station 20*b*, a development roller 70, rotating in the direction as shown, advances a liquid developer material 18*b* from the chamber of development housing to development a zone or nip 22*b*. An electrode 24*b* positioned before the entrance to development zone or nip 22*b* is electrically biased to generate an AC field just prior to the entrance to development zone or nip 22*b* so as to disperse the toner particles substantially uniformly throughout the liquid carrier. The toner particles, disseminated through the liquid carrier, pass by electrophoresis to the previous developed image. The charge of the toner particles is opposite in polarity to the charge on the previous developed image.

A second conditioning roller 26*b* contacts the developed image on belt 12 and conditions the image by compacting the toner particles of the image and reducing fluid content while inhibiting the departure of toner particles from the image. Preferably, the percent solids is more than 20 percent, however, the percent of solids can range between 15 percent and 40 percent. The images on belt 12 advances to lamp 76*b* where any residual charge left on the photoconductive surface is erased by flooding the photoconductive surface with light from lamp 76.

To similarly produce the third image using the third toner color, for example magenta color toner, the developed images on moving belt 12 are recharged with charging unit 17*c*, and re-exposed by a ROS 66*c*, which superimposes a third color image bitmap information over the previous developed latent image. At development station 20*c*, development roller 70, rotating in the direction as shown, advances a magenta liquid developer material 18*c* from the chamber of development housing to a development zone or nip 22*c*. An electrode 24*c* positioned before the entrance to development zone or nip 22*c* is electrically biased to generate an AC field just prior to the entrance to development zone or nip 22*c* so as to disperse the toner particles substantially uniformly throughout the liquid carrier. The toner particles, disseminated through the liquid carrier, pass by electrophoresis to the previous developed image. A conditioning roller 26*c* contacts the developed images on belt 12 and conditions the images by reducing fluid content so that the images have a percent solids within a range between 15 percent and 40 percent. The images or composite image on belt 12 advances to lamp 76*c* where any residual charge left on the photoconductive surface of belt 12 is erased by flooding the photoconductive surface with light from the lamp.

Finally, to similarly produce the fourth image using the fourth toner color, for example cyan color toner, the developed images on moving belt 12 are recharged with charging unit 17*d*, and re-exposed by a ROS 66*d*. ROS 66*d* superimposes a fourth color image bitmap information over the previous developed latent images. At development station 20*d*, development roller 70, rotating in the direction as shown, advances a cyan liquid developer material 18*d* from the chamber of development housing to a development zone or nip 22*d*. An electrode 24*d* positioned before the entrance to development zone or nip 22*d* is electrically biased to generate an AC field just prior to the entrance to development zone or nip 22*d* so as to disperse the toner particles substantially uniformly throughout the liquid carrier. The toner particles, disseminated through the liquid carrier, pass by electrophoresis to the previous developed image. A conditioning roller 26*d* contacts the developed images on belt 12 and conditions the images by reducing fluid content so that the images have a percent solids within a range between 15 percent and 40 percent. It should be evident to one skilled in the art that the color of toner at each development station could be in a different arrangement.

As illustrated the reproduction machine 10 includes an electronic control subsystem (ESS) shown as 148 for controlling various components and operating subsystems of the reproduction machine. ESS 148 thus may be a self-contained, dedicated minicomputer, and may include at least one, and may be several programmable microprocessors for handling all the control data including control signals from control sensors for the various controllable aspects of the machine.

The resultant composite multicolor image, a multi layer image by virtue of different color toner development by the developing stations 20*a*, 20*b*, 20*c* and 20*d*, respectively having black, yellow, magenta, and cyan, toners, is then advanced to a transfer station 78. At the transfer station 78, the resultant multicolor liquid image is subsequently electrostatically transferred with the aid of a charging device 82, to the image transfer assembly 150 of the present invention, which subsequently transfers the image onto an image receiving substrate or copy sheet 44. As shown, the image transfer assembly 150 has multiple intermediate transfer members 152 and 80 that are arranged and are suitable for transferring the toner developed image from the image forming surface 13 eventually onto the substrate or copy sheet 44, without adverse heat effects on the image forming surface 13.

The LID reproduction machine of the present invention is thus different from conventional LID reproduction machines in which a single intermediate transfer member is typically used. The single intermediate transfer member a conventional LID machine typically receives the toner developed image from the image forming surface, is heated to a temperature of about 100° C. in order to transfix the image to a copy sheet, and because it has to be rotated back into direct contact with the image forming surface, it ordinarily must therefore be actively cooled back down to about 40° C. As pointed out above, this ordinarily requires that the single intermediate transfer member be cycled from about 100° C. down to 40° C., and back up again to about 100° C. for each image transfer cycle or revolution of the transfer member. The undesirable consequence is clearly a problematic or disadvantageous, sizable and relatively more costly regenerative heat recovery system, usually including heating pads and cooling pads, heat pumps and associated hardware, thus adding to the size, cost and complexity of such a system. The energy requirements of such a system clearly appear prohibitive for just protecting the surface 13 from undesirable heat effects from the heated ITM.

However, the (multiple intermediate transfer member) image transfer assembly 150 of the present invention overcomes the disadvantages of conventional LID machines. As shown, the image transfer assembly 150 includes a first intermediate transfer member 152 that is mounted along the path of movement of the image forming surface 13, and in contact or image transfer relationship with the surface 13. The first intermediate transfer member 152 as mounted forms a first unheated image transfer nip 154 with the image forming surface 13 for cold transferring the toner developed image from the image forming surface 13 to the first intermediate transfer member 152, thereby passively protecting the image forming surface 13 from adverse heat effects, such as adverse heat effects from conventional direct contact of the surface 13 with an otherwise heated intermediate transfer member. The first intermediate transfer member 152 preferably is a rigid roll as shown, but it equally can be an endless belt having a path defined by a plurality of rollers in contact with an inner surface of such belt. The first intermediate transfer member 152 as such includes at least two layers of which a top layer shown as 160 consists of an image releasable coating for enabling unheated image transfer to a second intermediate transfer member in accordance with the present invention. The top or surface layer 160 preferably consists of a silicon rubber coating and an image releasing solvent applied thereto or soaked into it at a controlled rate. A preferred image releasing solvent has been found to be a high purity normal paraffin solvent sold as Norpar15™ (trademark of Exxon Chemical International Inc.).

Still referring to FIG. 1, the image transfer assembly 150 thus includes a release solvent applicator device shown as 162 that is mounted into contact with a cleaned portion of the surface layer 160, and immediately upstream of the image transfer nip 154, relative to direction of rotation of the intermediate member 152. Release solvent such as a high purity normal paraffin solvent (Norpar15™) can be supplied to the applicator device 162 from a container source (not shown). The release solvent can then be applied controllably in amounts as detailed below to the clean portion of the surface layer 160, just prior to image transfer within the first nip 154.

As further shown, the surface layer 160, after transferring a received image to the second intermediate transfer member within a second unheated nip 156, is cleaned by a cleaning device shown as 164.

The unheated first intermediate transfer member (ITM) 152 when soaked with a release solvent has been found to exhibit a relatively low "effective" surface energy. In one set of experiments, it was found that by coating and nearly saturating the first intermediate transfer member 152 with the solvent Norpar15™, toner developed images transferred from the surface 13 of the image forming member 12 within the first nip 154 to the first intermediate transfer member or ITM 152, and from the first ITM 152 within an unheated second nip 156 to a second intermediate transfer member merely with contact and light pressure.

Figure 2:
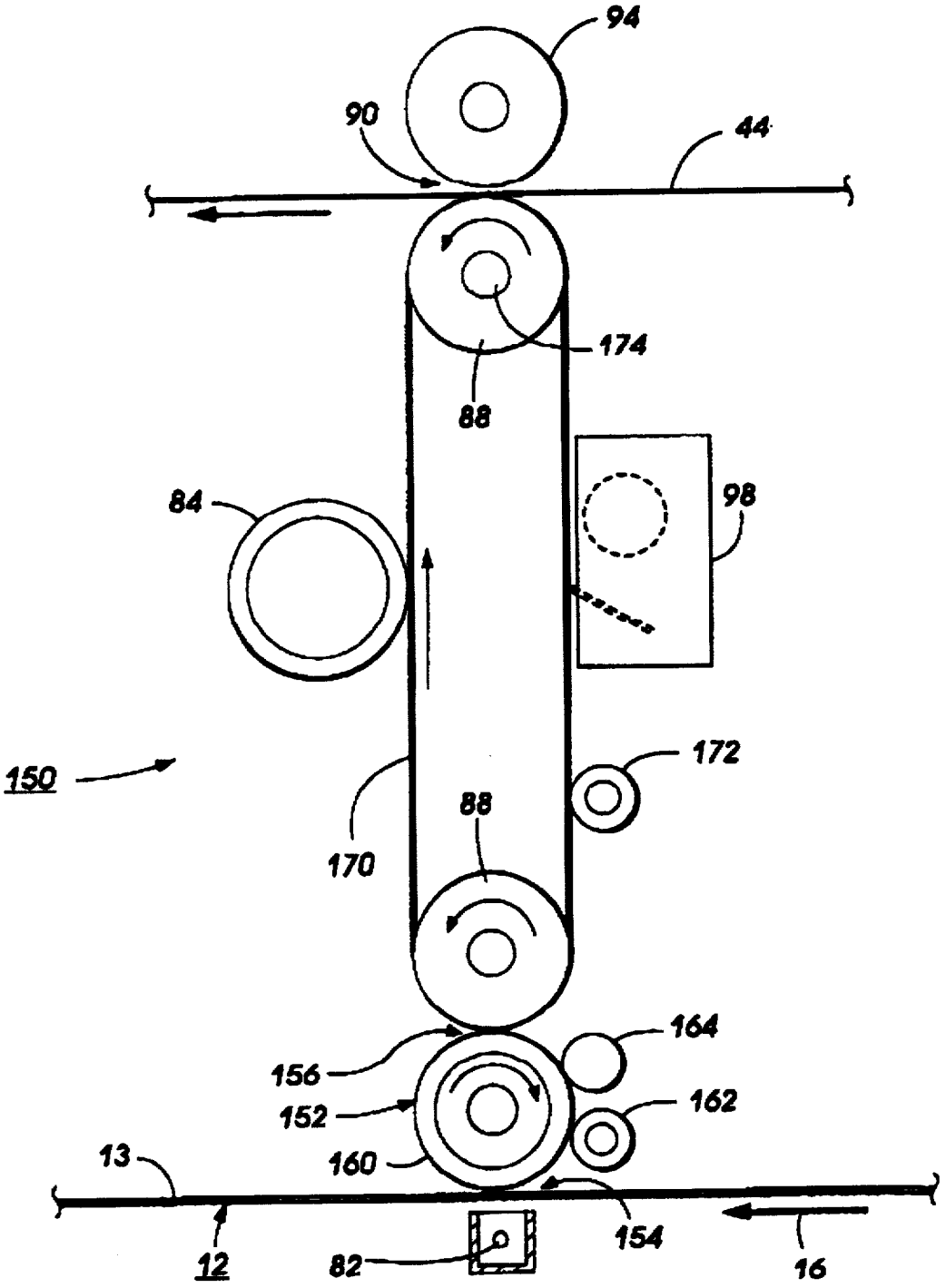
FIG. 2 is a vertical schematic of the image transfer assembly of the present invention, in a second arrangement in which the second intermediate member has a second type of surface coating.

Referring now to FIGS. 1 and 2, the image transfer assembly 150 also includes a second intermediate transfer member or ITM shown as 80 that is mounted spaced from the image forming surface 13 for receiving and transferring the toner developed image to the substrate or copy sheet 44. The second intermediate transfer member 80 as mounted forms the second unheated image transfer nip 156 with the first intermediate transfer member or ITM 152. It also forms a heated or transfixing image transfer nip 90 (away from the first intermediate transfer member 152) for hot transferring or transfixing the toner developed image onto the substrate or copy sheet 44.

As shown, the second intermediate transfer member or ITM 80 is preferably an endless belt, as shown, having a path defined by a plurality of rollers 88 in contact with the inner surface thereof, or it may be a rigid roll. It is preferred that the intermediate member or ITM 80 consist of at least two layers, the bottom layer of which should have a thickness greater than 0.1 mm and a resistivity of 106 ohm-cm. In a first embodiment of the second ITM 80 as shown in FIG. 1, the top or surface layer 166 preferably consists of a fluoroelastomer such as Viton™ (trademark of Du Pont UK Lid). Viton™ particularly is a fluoroelastomer of vinylidene fluoride and hexafluoropropylene. A fluoroelastomer or Viton™ coated surface 166 has been found to exhibit a higher "effective" surface energy relative to the solvent soaked silicon rubber surface 160 of the first ITM 152.

Experimentally, unheated image transfer from the first ITM to a second ITM was first demonstrated using a silicon rubber coating on the first ITM which had been treated or soaked in a controlled manner with Norpar15™, and using a Viton™ coating on the second ITM. Image transfer from the silicon rubber coating of the first ITM in a first unheated and relatively low pressure nip, such as nip 156, onto the Viton™ coated second ITM, was found to be 100% effective. Subsequent hot transfer or transfix of the image from the Viton™ coated second ITM to the copy sheet 44 was found to be about 95%. Silicon rubber layers or coatings on an ITM when treated with image release solvent such as Norpar15™ such that the solvent is absorbed into the silicon rubber layer, exhibit excellent image release characteristics when compared to other similar surface coating materials. The solvent soaked or laddened ITM was found to transfer 100% of the toner developed image thereon at relatively much lower pressures, and even at relatively lower temperatures than would be required for other surface coatings. In effect, at about fusing temperature and at low pressure, the silicon rubber coated ITM was found to exhibit a much lower "surface energy" or "effective surface energy", than a Viton™ coated ITM.

Still referring to FIG. 1, the image after transfer from the first ITM 152 to the second ITM 80 is first conditioned by a blotter device such as 84, and is subsequently heat transferred and fixed, or transfixed under a relatively higher pressure within a transfer nip 90 to the substrate or copy sheet 44. The Viton™ surface coating 166 of the second ITM 80 is then cleaned after such image transfer by a cleaning apparatus shown as 98 prior to the surface 166 rotating again into the unheated nip 156 to receive another image from the first ITM 152. Such cleaning of the surface 166 additionally serves to cool or reduce the temperature of the surface 166 from its temperature within the nip 90. As such, less heat is expected to reach the first ITM 152 from the second ITM 80.

Thus, the need for actively cooling either the second or first ITM 80, 152, respectively, in order to protect the surface 13 from adverse heat effects from the second ITM 80, will be minimized, if not eliminated. In any case, even if some active cooling of the first ITM 152 were necessary to further ensure prevention of adverse heat effects to the image bearing member, such active cooling will be substantially less than what would otherwise be required for conventional single, heated ITM machine.

Although the blotter device 84 is shown mounted for conditioning the toner developed image against the second ITM 80, it is understood that the blotter device 84 could equally be mounted for the same purpose against the first ITM 152.

Referring now to FIG. 2, the image transfer assembly 150 of the present invention is again illustrated, showing a second arrangement including a second embodiment of the second ITM 80 surface layer coating shown as 170, and a second image release solvent applicator device 172. In accordance with the present invention, the surface layer or coating 170 of the second ITM 80 preferably consists of silicon rubber that is soaked with the same or similar image release solvent as is the surface layer 160 of the first ITM 152. Accordingly, the image transfer assembly 150 according to this embodiment, also includes a second release solvent applicator device shown as 172 that is mounted into contact with a cleaned portion of the surface layer 170, an immediately upstream of the image transfer nip 156, relative to direction of rotation of the ITM 80. The release solvent is therefore, for example, a high purity normal paraffin solvent (Norpar15™) which can be supplied to the applicator device 172 from a container source (not shown). The release solvent is applied controllably in an amount that on the same basis, is less than that applied to the silicon rubber surface 160 of the first ITM 152.

In further experiments it was found that the direction of unheated image transfer between solvent soaked silicon rubber coated surfaces depended in great part on a difference in the amount of solvent absorbed by the surfaces. In particular, it was found that under the same conditions, the image transferred from the surface having a higher amount of solvent, to the surface having the lower amount of solvent. Although heat appears to still be helpful, it was found that image transfer can be achieved in the direction as above, even at room temperature, and with relatively very little pressure, particularly if there is a sufficient and significant difference in the amounts of the solvent soaked into the surfaces. It is preferred for example that the first release solvent applicator device 162 be controlled so that the unheated first silicon rubber surface 160 of the first ITM 152 is made to absorb a large amount of about 40% or more by weight of the release solvent, such as of Norpar15™. Accordingly, it is then preferred that the second applicator device 172 be controlled so that the silicon rubber surface 170 of the second ITM 80 is made to absorb less than 40% by weight of the solvent, so as to effect high quality unheated image transfer as above.

In fact, it was discovered that, if the heated second silicon rubber layer 170 of the second ITM 80 was soaked so that it contained a very low amount, say less than 25% by weight of the solvent, the image would transfer to it practically at room temperature, and at a very low pressure, from the first silicon rubber surface 160 of the first ITM 152 (which of course is soaked with more than 25% by weight of the solvent). In fact, the pressure used for such a transfer was supplied by a mere finger pressing the two surfaces together.

Silicon rubber is the preferred material for making the top layer 170 of the second intermediate transfer member 80 because of its characteristics of being able to transfix to paper with 100% efficiency, as opposed to a 95% efficiency as found above with a Viton™ coating.

With either embodiment of the surface coating of the second ITM 80, effective transfixing of the toner developed image in the transfix nip 90 requires that the second intermediate transfer member 80 be heated as by a heat source 174 to a temperature of about 100° C. Where transfixing alone as within the nip 90 is not sufficient, or where standalone fusing is desired, the toner developed image on the copy sheet 44 can be fully fused at a fuser or fusing station 100. As shown, the fusing station 100 for example includes a pressure roller 102, and a fuser roller 104 having a heat source 106. Where a standalone fusing station 100 is provided as shown, the toner developed image alternatively can actually be transferred with high efficiency and without heat within the nip 90 onto the substrate or copy sheet 44, and then subsequently fixed to the substrate or copy sheet 44 utilizing the stand alone fuser 100. In such an alternative embodiment, the heat source 174 can either be done away with altogether, or be operated at a reduced temperature level so as to further reduce any risk of adverse heat effects indirectly reaching the surface 13 from the nip 90. As further shown, the transfixed or fused image on the copy sheet 44 eventually is fed to an output tray shown as 50 for subsequent removal by an operator.

In fact, it was found that when using a second intermediate transfer member 80 that is coated with silicon rubber, and that is soaked with Norpar15™, to where it was nearly saturated, toner developed images consisting of 25% toner solids and 75% liquid carrier (e.g. Norpar15™) were transferred as in a nip 90 over a range of temperatures from 20° C. to 110° C. to a substrate or copy sheet at a 100% efficiency rate. It is believed that within the temperature range 20° C.–110° C., critical parameters for high efficiency unheated image transfer within the nip 90 include the amount of image release solvent or carrier fluid applied by the applicator device 172 to the silicon rubber layer 170 of the second ITM 80; an amount of carrier fluid left in the image after conditioning by the blotter device 84; and the pressure applied at the nip 90.

As can be seen, there has been provided a LID reproduction including an image transfer assembly that effectively achieves high quality image transfer from the image forming surface onto a receiving substrate or copy sheet, while effectively protecting the image forming surface from adverse heat effects of direct contact with a heated intermediate transfer member. The LID reproduction machine as provided thus overcomes the disadvantages of conventional LID reproduction machines. While the invention has been described with reference to particular preferred embodiments, the invention is not limited to the specific examples shown, and other embodiments and modifications can be made by those skilled in the art without depending from the spirit and scope of the invention and claims.

What is claimed is:

1. A liquid immersion development (LID) reproduction machine having a heat protected image forming surface, the LID reproduction machine comprising:

(a) a movable image forming member having a path of movement and a heat protected image forming surface;

(b) means mounted along said path of movement for forming a latent image onto said image forming surface;

(c) development means mounted along said path of movement and containing liquid developer consisting of liquid carrier and charged toner particles for developing said latent image forming a toner developed image; and (d) an image transfer assembly including multiple intermediate transfer members for transferring the toner developed image from said image forming surface onto a copy substrate while heat protecting said image forming surface, said image transfer assembly including a first intermediate transfer member mounted along said path of movement forming an unheated image transfer nip with said image forming surface for cold transfer of the toner developed image onto said first intermediate transfer member, thereby heat protecting said image forming surface, said first intermediate transfer member including a top surface layer consisting of a silicon rubber coating, as well as, a release solvent being applied to said silicon rubber layer at a first rate, and said image transfer assembly including a second intermediate transfer member mounted spaced from said image forming surface for receiving and transferring the toner developed image onto a copy substrate, said second intermediate transfer member forming an unheated image transfer nip with said first intermediate transfer member, and a heated transfix nip for transferring the toner developed image onto the copy substrate, and said second intermediate transfer member including a top surface layer consisting of a silicon rubber coating, and a release solvent being applied to said silicon rubber layer at a second rate less than the first rate of application to said first intermediate transfer member for effecting high quality low pressure, low temperature image transfer from said first intermediate transfer member to said second intermediate transfer member.

2. The LID reproduction machine of claim 1, including a first solvent applicator device mounted into contact with said top surface of said silicon rubber layer of said first intermediate transfer member for controllably applying said release solvent onto said silicon rubber surface.

3. The LID reproduction machine of claim 2, including a second solvent applicator device mounted into contact with said top surface of said silicon rubber layer of said second intermediate transfer member for controllably applying said release solvent onto such surface.

4. The LID reproduction machine of claim 3, wherein said second solvent applicator device controllably applies said release solvent onto said silicon rubber surface such that said surface layer of said second intermediate transfer member contains about 25% or less of the solvent by weight.

5. The LID reproduction machine of claim 2, wherein said first solvent applicator device controllably applies said release solvent onto said silicon rubber surface such that said surface layer of said first intermediate transfer member contains about 40% or more of the solvent by weight.

6. The LID reproduction machine of claim 1, wherein said release solvent being applied is a high purity normal paraffin solvent.

* * * * *